US005105560A

United States Patent [19]

Ruiz-Avila et al.

[11] Patent Number: 5,105,560

[45] Date of Patent: Apr. 21, 1992

[54] APPARATUS AND PROCESS FOR DRYING AND COMMINUTING MATTER

[75] Inventors: Jose L. Ruiz-Avila; Ivan G. Casten, both of Queensland, Australia

[73] Assignee: AKT Consultant Pty Limited, Queensland, Australia

[21] Appl. No.: 542,182

[22] Filed: Jun. 22, 1990

[30] Foreign Application Priority Data

Nov. 3, 1988 [AU] Australia ..... PJ1280
Dec. 16, 1988 [AU] Australia ..... PJ2005
Sep. 28, 1989 [AU] Australia ..... PJ6639
Nov. 3, 1989 [AU] Australia ..... PCT/AU 89/00475

[51] Int. Cl.[5] ..... F26B 19/00; F26B 11/12; B02C 23/02

[52] U.S. Cl. ..... 34/60; 34/102; 34/181; 241/19; 241/186.3

[58] Field of Search ..... 34/57 D, 59, 60, 179, 34/181, 182, 102; 241/18, 19, 186.2, 186.3

[56] References Cited

U.S. PATENT DOCUMENTS 2,112,333 3/1938 Crew ..... 241/18 X
2,922,586 1/1960 Hardinge ..... 241/19
3,030,037 4/1962 Raetz ..... 241/186.3 X
3,078,048 2/1963 Russell et al. ..... 241/19 X
4,798,345 1/1989 Adolph ..... 241/186.2

FOREIGN PATENT DOCUMENTS 569839 7/1983 Australia ..... 34/168
3300133 7/1984 Fed. Rep. of Germany ... 241/186.3
0117164 7/1946 Sweden ..... 34/102
0431374 4/1975 U.S.S.R. ..... 34/102
1071902 2/1984 U.S.S.R. .
1198350 12/1985 U.S.S.R. .

*Primary Examiner*—Henry A. Bennet
*Assistant Examiner*—Christopher B. Kilner
*Attorney, Agent, or Firm*—Abelman, Frayne & Schwab

[57] ABSTRACT

A flow dryer is disclosed for comminuting and dehydrating matter using a stream of hot gas, said flow dryer being of the type employing an inlet duct in series with an agitator followed by a drying duct, the agitator having an inlet communicating with the inlet duct and an outlet communicating with the drying duct in order for hot gas to flow through the agitator, and control means operable to vary the residence time of matter in the agitator by varying the required exit characteristics for comminuted matter leaving the agitator through the agitator outlet.

13 Claims, 8 Drawing Sheets

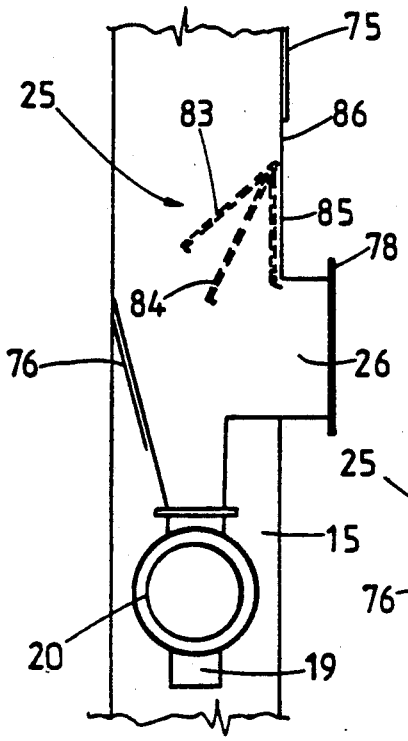
Fig. 8A
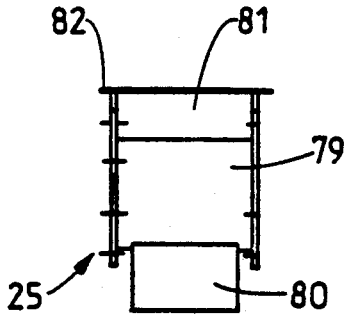
Fig. 8 B
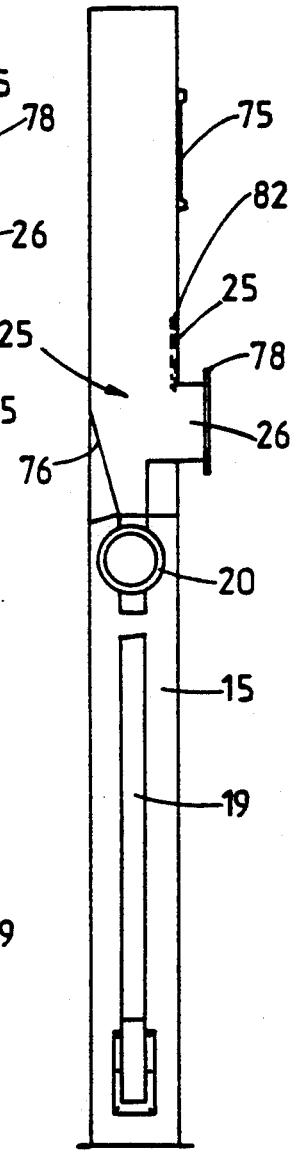
Fig. 8
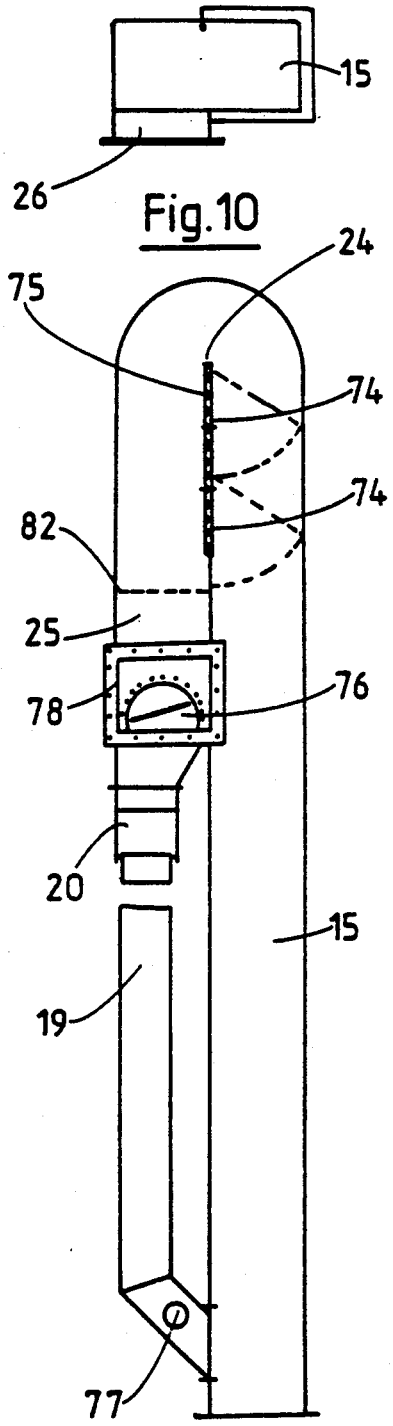
Fig. 10
Fig. 9

APPARATUS AND PROCESS FOR DRYING AND COMMINUTING MATTER

TECHNICAL FIELD

This invention relates to an apparatus and process for drying and comminuting matter using a flow dryer of the type employing an inlet duct in series with an agitator followed by a drying duct through which matter to be dried is passed using a stream of heated gas and in particular to a flow dryer which can be readily adapted to dry different materials.

BACKGROUND ART

Known flow dryers commonly employ an inlet duct in series with an agitator followed by a drying duct. A stream of hot gas is blown through this series arrangement and matter entrained in the stream is dried and comminuted, a cyclonic separator is usually connected to the drying duct and is employed to separate the saturated gas from the dry comminuted product. Matter to be dried is usually fed into the agitator where it is broken up and partially dried and comminuted before it is transferred to the drying duct. The agitator presents resistance to flow through the flow dryer and this resistance depends on the nature and character of the matter being processed and how that matter interacts with the agitator to degrade the gas stream. Under these circumstances, the velocity of the air travelling through the drying duct and the actual drying conditions in the drying duct are unpredictable because the resistance in the agitator depends on a number of factors including the turbulence created by the agitator, the density of the air containing the partially comminuted matter in the agitator and the flow directional changes, of up to 280 degrees, consequent to the operation of the agitator on the partially comminuted matter.

The result of this is that there is difficulty in predicting the velocity of the gas through the drying duct and as a consequence, a difficulty in predicting the residence time for any particular material.

The applicant's U.S. Pat. No. 4,573,278, the disclosure of which is incorporated into the present specification, describes a flow dryer which incorporates a plurality of adjustable baffles in the drying duct in order to vary the path length of matter flowing through the drying duct, by virtue of this change in path length, residence time in the drying duct can be altered so the flow dryer can be adapted to process different materials having different moisture content. In some cases however, this arrangement does not provide a long enough residence time in order to provide adequate drying and it is usually not practical to extend the drying duct to give higher residence times. This is particularly the case where particles of comminuted matter, after having entered the drying duct reach their terminal velocity before drying is complete. The end result in this case is usually a wet product independent of the length of the drying duct.

While this proposal, under many circumstances enables different materials to be treated using the one machine the arrangement is not effective in some circumstances. In addition the arrangement of baffles is expensive to manufacture. It would therefore be desirable to provide an alternative means by which a flow dryer could be adapted to treat different materials.

DISCLOSURE OF THE INVENTION

It is a principal object of the present invention to alleviate at least to some degree the aforementioned problems associated with the prior art.

In one aspect therefore the present invention resides in a flow dryer for comminuting and dehydrating matter using a stream of hot gas, said flow dryer being of the type employing an inlet duct in series with an agitator followed by a drying duct, said agitator having an inlet communicating with the inlet duct and an outlet communicating with the drying duct in order for hot gas to flow through the agitator, and control means to vary the residence time of matter in the agitator by varying the required exit characteristics for comminuted matter leaving the agitator through the agitator outlet. The exit characteristics refers to those characteristics of a particle in the agitator which enables that particle to be swept from the agitator and into the drying duct as a result of the prevailing conditions in the agitator. The exit characteristics include principally, weight, density, surface area, volume and shape and the relative importance of the characteristics is dependent on the nature of the matter being processed. Although a range of particles will exit the agitator the present invention enables the average exit characteristics of a quantity of matter to be altered therefore the average residence time of matter in the agitator can be controlled.

In a further aspect the invention resides in an agitator suitable for use in a flow dryer for comminuting and dehydrating matter using a stream of hot gas flowing through the agitator, the agitator having an agitator chamber including an inlet and an outlet for the hot gas, a plurality of blades mounted for rotation inside the agitator chamber, the agitator having a control means operable to vary the residence time of matter in the agitator by varying the required exit characteristics of matter leaving the agitator through the agitator outlet.

In another aspect the invention resides in a process for comminuting and dehydrating a quantity of moist matter using a stream of hot gas flowing through a flow dryer, the flow dryer being of the type employing an inlet duct in series with an agitator followed by a drying duct, the agitator having an inlet communicating with the inlet duct and an outlet communicating with the drying duct, the process comprising simultaneously introducing a portion of the moist matter into the agitator while subjecting same to the influence of the stream of hot gas, directing said stream to dehydrate the matter entrained therein while the matter is comminuted by the agitator, adjusting the residence time of the comminuted matter in the agitator to an optimum setting by varying the required exit characteristics for comminuted matter leaving the agitator through the agitator outlet to achieve a desired product, and thereafter processing more of the moist matter using the optimum residence time setting.

The flow dryer preferably includes a blower and a burner chamber. The burner chamber is preferably connected in series with the inlet duct and communicates with the upstream end of the inlet duct. The burner chamber preferably has a variable fire burner and can be used to vary the temperature of gas delivered to the inlet duct. Preferably the blower is connected in series with the burner chamber at the upstream end of the burner chamber to direct gas through the burner chamber and into the inlet duct. Alternatively, the blower can be located downstream of the drying duct in order to apply suction to draw gas through the burner chamber and into the inlet duct, through the agitator, through the drying duct and the through the blower.

A gas intake can be employed downstream of the burner in order to compensate for any losses in gas velocity or mass flow rate as a consequence of the burner operation. The intake is preferably variable to vary the amount of air introduced into the hot gas.

The flow dryer can employ a classifier downstream of the drying duct to separate comminuted matter of different particle size and/or different densities. The classifier can operate in conjunction with a return duct and an outlet duct. The return duct preferably communicates with the inlet duct to return unclassified comminuted matter for reprocessing. The outlet duct can communicate with an appropriate separator, commonly a cyclonic separator, where the dried comminuted matter is separated from the saturated gas and thereafter collected.

The stream of hot gas delivered to the inlet duct is usually in the range of from 200° C. to 1300° C. but preferably in the range from 200° C. to 500° C., and can be made up of a primary stream augmented by an auxiliary stream. Preferably the auxiliary stream is introduced into the primary stream just after the primary stream leaves the agitator at a location adjacent the agitator outlet. Preferably the mass flow rates of the primary stream and the auxiliary stream are controllable. Preferably the mass flow rates of the primary stream and the auxiliary stream are interdependent. Advantageously, the mass flow rate of the primary stream is controlled so as to be inversely proportional to the mass flow rate of the auxiliary stream.

The process can be modified where the primary stream of gas is employed augmented by an auxiliary stream of gas. In this aspect the process comprises simultaneously comminuting the matter in the agitator while subjecting same to the influence of the primary stream of hot gas at a temperature of from 200° C. to 1300° C., preferably from 200° C. to 500° C., directing said primary stream to dehydrate the comminuted matter in the agitator for a predetermined period of time determined by the required exit characteristics for comminuted matter leaving the agitator, subsequently introducing into said primary stream the auxiliary stream of hot gas at a temperature of from 200° C. to 1300° C., preferably from 200° C. to 500° C., at a controlled mass flow rate to form with the primary stream, a combined stream of gas in the drying duct, classifying the combined stream and the entrained comminuted matter contained therein into a return stream containing comminuted matter to be recycled through the flow dryer, and an outlet stream of saturated gas containing relatively dry comminuted matter, returning the return stream and the matter entrained therein into either the primary stream or the combined stream of hot gas initially influencing and entraining the comminuted matter, separating the relatively dry comminuted matter from the gas in the outlet stream, exhausting the gas in the outlet stream and collecting the comminuted product.

Where the flow dryer employs a primary stream augmented by an auxiliary stream, it is preferably modified to enable the auxiliary stream to be introduced into the primary stream after the primary stream leaves the agitator. In this aspect, the flow dryer comprises a primary inlet duct in series with the agitator followed by the drying duct, the agitator having an inlet communicating with the primary inlet duct adjacent the downstream end of the primary inlet duct, and an outlet communicating with the drying duct adjacent the upstream end of the drying duct, an auxiliary inlet duct communicating with the drying duct adjacent the upstream end of the drying duct, and the control means is operable to control the residence time of matter in the agitator and to control the mass flow rate of the auxiliary stream introduced into the drying duct through the auxiliary inlet duct.

The primary inlet duct and the auxiliary inlet duct can communicate with a common blower via a common inlet duct or alternatively separate blowers can be provided for the primary inlet duct and the auxiliary inlet duct. Where a common inlet duct is employed to deliver gas to both the primary inlet duct and the auxiliary inlet duct, the common inlet duct and the drying duct are preferably spaced upright ducts extending upwardly from the agitator, and the auxiliary duct is located above the agitator and extends from the common inlet duct across to the drying duct.

The auxiliary inlet duct can be independent of the primary inlet duct. Where a common inlet duct is employed, the primary inlet duct and the auxiliary inlet duct can branch from the common inlet duct upstream of the agitator so that some gas travelling along the common inlet duct is diverted passed the agitator to the drying duct, the control means being operable to control the amount of gas diverted.

The agitator can be of any known form, but is preferably a rotary agitator employing a rotatable shaft with a number of arms or blades, the blades being designed to maintain the incoming moist matter in the hot gas stream until such time as the matter has been comminuted so that the exit characteristics of the comminuted particles is such that the particles can be transported through the agitator into the drying duct by the gas stream. A feeder can be provided outside the agitator and preferably comprises an input feed auger or paddle through which incoming matter can be fed to the agitator.

In one preferred form the agitator preferably comprises a plurality of blades located in an agitator chamber, the chamber having opposed end walls and curved walls extending between the end walls. The agitator chamber is preferably cylindrical, and the blades rotate on a shaft co-axial with the longitudinal axis of the chamber in order to cut a cylindrical volume closely spaced from the walls of the chamber. The agitator inlet and the agitator outlet preferably comprise respective spaced openings in the curved wall of the agitator chamber. Advantageously, the agitator inlet and the agitator outlet are both located in the same hemicylindrical section of the chamber.

The opening which forms the agitator inlet preferably includes an upstream edge and an opposed wall section extending out of the chamber. The wall section is preferably tangential to the curved wall of the chamber.

The opening which forms the agitator outlet preferably includes an upstream edge and an opposed wall section extending out of the chamber. The wall section is preferably contiguous with the curved wall of the chamber.

Advantageously, the centre of each opening is located on an imaginary tangential surface extending from the respective edges to the respective wall sections and approximately on the line of contact of the imaginary tangential surface with an imaginary cylinder defining the cutting volume of the blades.

The agitator preferably includes a service opening in an end wall in order to enable the blades to be serviced. The agitator chamber can include a wear lining. The wear lining can be a curved plate securable to the inner surface of the curved wall of the agitator chamber. The wear lining is preferably of the same curvature as the wall of the chamber. A service opening is preferably provided adjacent the curved wall of the agitator chamber to facilitate replacement of the wear lining.

Each of the service openings are preferably provided with a removable cover plate.

Each end wall of the agitator is preferably a plate extending beyond the curved wall of the agitator so as to form a wall portion of the inlet duct and the drying duct and also the auxiliary duct where an auxiliary duct is employed.

The flow control valve can be located upstream of the agitator inlet or at the agitator. Where an auxiliary gas stream is employed and the auxiliary stream and the primary stream share a common inlet duct the flow control valve and the auxiliary control valve can operate interdependently. In the case of a common inlet duct branching into the primary duct and the auxiliary duct, the flow control valve and the auxiliary control valve can be provided by a single valve plate located adjacent the juncture between the auxiliary inlet duct and the primary inlet duct. In a preferred form, the valve plate is pivotally connected adjacent the auxiliary inlet duct to selectively divert a portion of the gas into the auxiliary inlet duct, so that the mass flow rate of the primary stream as delivered to the agitator is inversely proportional to the mass flow rate of the gas travelling through the auxiliary inlet duct. Advantageously, the valve plate can be used to completely close the auxiliary inlet duct so all gas is delivered to the agitator.

The agitator outlet valve is preferably located adjacent the agitator outlet in order to control the required exit characteristics for comminuted matter leaving the agitator by controlling the size of the agitator outlet. In a preferred form the agitator outlet valve comprises a sliding plate which can be moved into the agitator outlet to selected locations. In a further embodiment the agitator outlet valve comprises a pivoting plate which can be pivoted to selected locations in order to partially close the agitator outlet.

Thus, by operation of the flow control valve the mass flow rate of gas delivered to the agitator can be controlled, thus controlling the mass flow rate of gas through the agitator and hence the residence time of matter in the agitator. The agitator outlet valve can restrict the size of the outlet so that for any setting relatively large particles of matter will be deflected back into the path of the blades and recycled through the agitator. As a consequence, the residence time of matter in the agitator can be controlled independently of the flow control valve setting. However, because it is necessary to maintain at least some flow through the agitator, there is a limit to the amount the agitator outlet can be closed without blockages occurring, as a consequence, the provision of both a flow control valve and an agitator outlet valve is especially preferred to enable finer control of residence time.

When treating material such as bones there is a tendency for the bones to be deflected through the agitator inlet and due to the velocity imparted to the bone product, and their size, the bone product is liable to travel backward against the gas stream through the inlet and into the burner chamber. In order to obviate this problem, it is preferable that the agitator inlet include a deflector means extending across a part of the agitator inlet in order to deflect matter being thrown against the deflector means by the blades back into the path of the blades. Preferably the deflector means comprises a deflector plate extending generally parallel to an imaginary tangential surface to an imaginary cylinder defined by the free ends of the rotating blades or at a position so that an extension of the plate would intercept with the imaginary tangential surface. The deflector means can be fixed or it can be adjustable to vary the angle of intersection with the imaginary tangential surface. Advantageously, the deflector plate can also be used to divert a portion of the stream of hot gas preferentially towards the free ends of the blades.

The agitator blades can each be of any desired shape or configuration but each blade preferably includes a free end and a deflecting surface located adjacent the free end, and being adapted to preferentially deflect matter striking the deflecting surface in an inward direction rather than a radial direction so that matter striking the deflecting surface is deflected into the path of the blades.

The drying duct can be a set length or can be of variable length. The drying duct is preferably a vertical duct having arcuate and/or planar walls, and can have a vertically extending partition providing an upwardly extending portion and a downwardly extending portion to cause the gas stream travelling through the drying duct to flow upwardly over the partition and downwardly to the outlet duct. Advantageously, the partition comprises a plurality of adjustable baffles which are operable to vary the length of the drying duct in the fashion described in the applicant's U.S. Pat. No. 4,573,278.

The outlet duct can extend horizontally from the downstream end of the drying duct to a separator, and preferably extends from the downwardly extending portion of the drying duct just upstream of the return duct. The separator is preferably a cyclone communicating with the downstream end of the outlet duct.

The classifier can be of any known form but is preferably of the type which separates air strata of different densities and/or particles of different weight, and is preferably located adjacent the downstream end of the drying duct adjacent the juncture between the drying duct and the outlet duct. The classifier preferably includes a deflector plate which can be selectively extended into the gas stream a predetermined distance from a wall of the drying duct. The deflector plate is preferably hinged to the wall of the drying duct so it can be set at a preselected angle to the wall in order to deflect the gas flow toward the return duct. The deflecting effect of the deflector plate is to a greater degree where the angle to the wall is relatively large and the deflector plate is fully extended into the gas stream. The deflector plate preferably operates in conjunction with an airlock located in the return duct so that the gas stream flows into the outlet duct thus taking the entrained smaller and dryer particles to the separator while heavier particles are deflected and fall into the airlock, and thereafter into the return duct to the reprocessed. The airlock is preferably a rotary airlock.

Where an auxiliary gas stream is employed, it is preferable to provide the auxiliary gas stream and the primary gas stream from a common blower, and to this end as mentioned above it is preferable to provide the auxiliary inlet duct and the primary inlet duct as respective branches of a common inlet duct. In this arrangement, the common inlet duct communicates at its upstream end with a burner chamber, and at its downstream end branches into the primary and auxiliary ducts. The primary duct preferably includes a wall section contiguous with the tangential wall section extending from and defining the agitator inlet. The auxiliary inlet duct preferably communicates with the drying duct at an opening downstream of the agitator. The opening preferably includes a grid or apertured portion of the drying duct wall in order to inhibit back flow of matter into the auxiliary inlet duct.

The return duct can be connected at its downstream end to the drying duct upstream or downstream of the auxiliary inlet duct. Alternatively, the return duct can return matter directly to the agitator or to a location upstream of the agitator. Preferably, the return duct is connected to the inlet duct upstream of the agitator.

From the foregoing it will be apparent that the present invention provides greater control over the processing of animal, mineral or vegetable matter than was known in the prior art and thus a comminuted product can be provided having higher quality and having enhanced characteristics such as a longer shelf life, more uniform final moisture content, more uniform particle size and more uniform density.

Accordingly, in a still further aspect the present invention resides in animal, mineral or vegetable matter when reduced to comminuted matter after having been processed through a flow dryer as described above.

BRIEF DESCRIPTION OF THE DRAWINGS

In order that the invention may be more readily understood and be put into practical effect reference will now be made to the accompanying drawings and wherein:

FIGS. 8, 9 and 10 are respective side, front and plan views illustrating the drying duct and return duct portions of FIG. 1;

FIGS. 8A and 8B are detailed views on an enlarged scale illustrating the operation of one preferred classifier as depicted in FIG. 8;

BEST MODE FOR CARRYING OUT THE INVENTION

Figure 1:
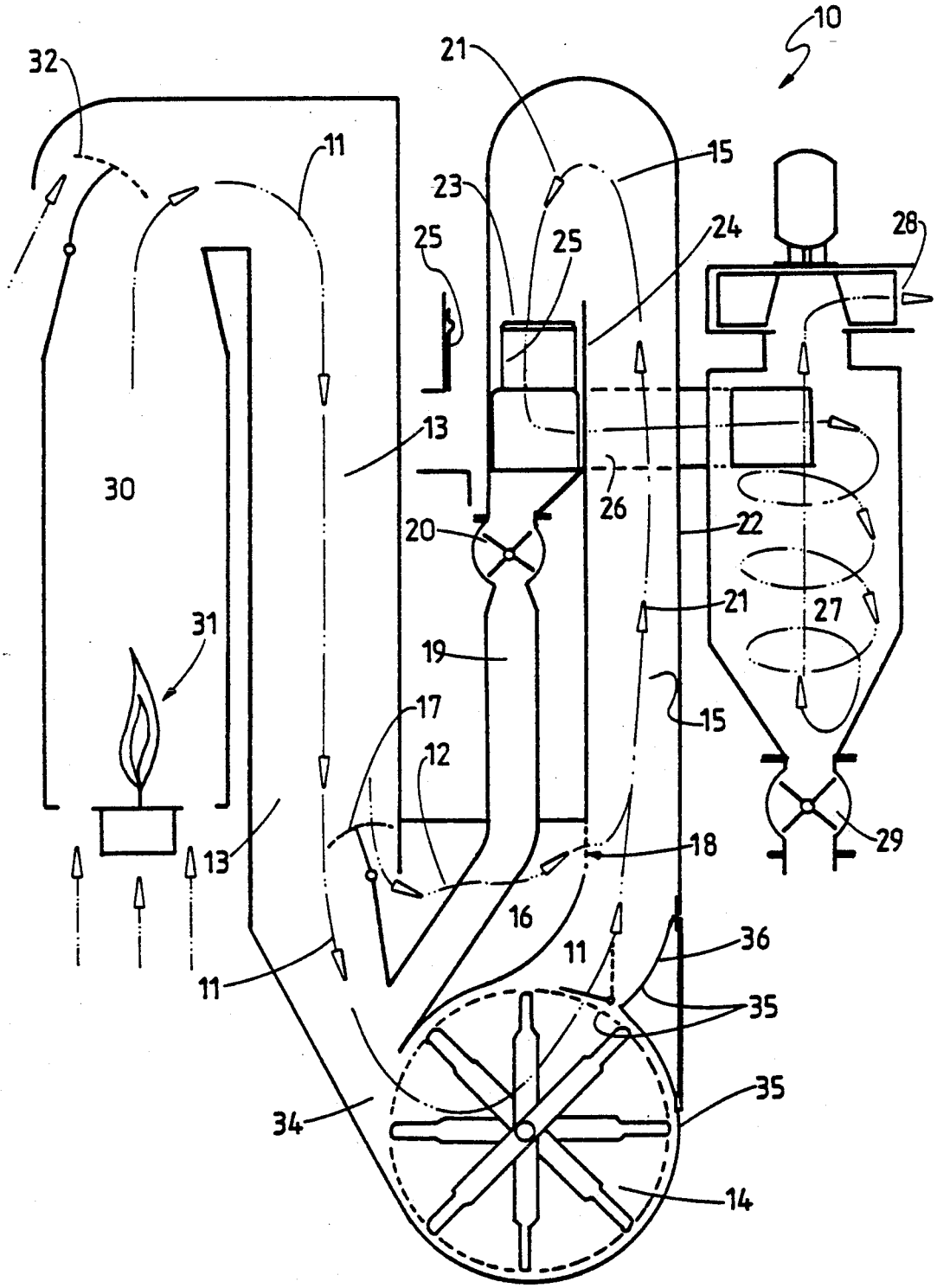
FIG. 1 is a schematic vertical cross-section through a flow dryer constructed in accordance with one preferred embodiment of the present invention.

Referring to FIG. 1, there is illustrated in vertical cross-section a flow dryer 10 for drying matter using a primary gas stream 11 of hot gas augmented by an auxiliary gas stream 12 of hot gas. The primary gas stream 11 and the auxiliary gas stream 12 are fed from a common gas stream flowing along a common inlet duct 13. The gas temperature in streams 11 and 12 is in the range of 200° C.-1300° C. and preferably from between 200° C. and 500° C.

The primary stream 11 of hot gas flows to an agitator 14, and from the agitator 14 into a drying duct 15, a feeder (not shown) is employed to feed matter to be dried into the agitator 14.

The auxiliary stream 12 travels along an auxiliary inlet duct, in this case in the form of a plenum 16 communicating at its upstream end with the common inlet duct 13 and at its downstream end with the drying duct 15.

A control means in the form of a flow control valve 17 is located adjacent the upstream end of the plenum 16 in order to control the flow of hot gas through the plenum 16 and into the drying duct 15 through an opening in the form of a grid 18, and also the flow of hot gas delivered to the agitator 14. The grid 18 is employed to prevent back flow of matter into the auxiliary inlet duct.

Adjacent the downstream end of the drying duct 15 is connected a return duct 19 which communicates between the downstream end of the drying duct 15 and upstream of the agitator 14.

A classifier in the form of a pivoting deflector plate 25 is located adjacent the downstream end of the drying duct 15 and is employed to direct relatively heavy and relatively moist comminuted matter back to the return duct 19 for further processing, and to direct saturated gas and relatively dry comminuted matter to an outlet duct 26.

A rotary airlock 20 is employed in the return duct so that matter falling into the return duct returns to the primary inlet duct 13 under the influence of gravity while the gas in the combined stream 21 flows into the outlet duct 26. Hence the classifier classifies particles by weight and degree of deflection caused by plate 25.

As can be seen therefore, material passing into agitator 14 is tossed and broken up in the agitator under the influence of the primary stream 11 and the action of the agitator, wherein the material is partially dried and conveyed by the primary stream 11 into the drying duct where it also comes under the influence of the auxiliary stream 12. By operating valve 17, the mass flow rate of the auxiliary stream 12 can be controlled so as to augment the primary stream 11 after the primary stream 11 leaves the agitator 14. Thus losses in the primary stream 11 due to resistance to flow and degradation of the primary stream 11 created by the agitator operation can be compensated by the auxiliary stream 12. For example the temperature drop across the agitator can be as much as 200° C. to 250° C. for an inlet temperature of 450° C., thus the auxiliary stream at 450° C. provides a boosting effect in the drying duct.

As a consequence conditions in the drying duct can be adjusted from a condition where no auxiliary stream is being introduced, that is when valve 17 is fully closed, to a maximum mass flow rate of the auxiliary stream, when valve 17 is fully open. It has been found that accurate control of the combined gas stream 21 can be achieved using this arrangement and the treatment conditions for any particular comminuted matter in the drying duct is therefore continuously variable between the minimum and maximum limits. By varying the conditions in the drying duct in this fashion for a set length drying duct, the residence time of matter in the drying duct can be controlled and as well the auxiliary stream 12 can enhance drying by providing unsaturated hot gas directly into the drying duct without having been degraded in the agitator 14.

A further consequence of the specific embodiment shown is that varying valve 17 will reduce or increase the mass flow rate of air delivered to the agitator 14. The result is that the resistance factor in the agitator is modified accordingly thereby changing the exit characteristics required for matter leaving the agitator through the agitator outlet. Thus when valve 17 is open to its maximum the primary flow will be at a minimum and the residence time in the agitator will be a maximum for a constant agitator outlet size. The residence time in the agitator will be a minimum when valve 17 is closed.

Thus, the primary stream 11 and the auxiliary stream 12 in this embodiment are interdependent but it will be realised that separately controlled streams are an alternative where independent control is desirable. In the illustrated embodiment the mass flow rate of gas in the primary stream 11 is inversely proportional to the mass flow rate of gas in the auxiliary stream 12. The actual velocity of gas at any point in the flow dryer will of course be dependent on the cross-sectional area of the ducting at the specific location.

In the illustrated embodiment the drying duct 15 is a vertical duct having an upwardly extending portion 22, and a downwardly extending portion 23 separated by a partition 24 over which the combined stream 21 flows.

The deflector plate 25 is operable to deflect the combined stream and its entrained comminuted matter toward return duct 19 so that under the combined influence of deflector plate 25 and rotary airlock 20 relatively heavy moist particles fall into return duct 19. The combined stream 21 and the dry comminuted matter entrained therein is diverted into outlet duct 26 leading to cyclone 27 whereafter the saturated gas is separated from the comminuted matter and exhausted at 28. The dry comminuted product can be dispensed from the cyclone 27 through rotary airlock 29. The product can thereafter be further classified using say, a sieve, and if necessary any larger particles can be returned to the flow dryer for further processing.

The primary gas stream is provided by a burner chamber 30 in series with the common inlet duct 13 and a blower (not shown). At high fire the flame 31 of the burner chamber 30 can modulate the air flow through the burner chamber 30. To reduce the effect of modulation at high fire a variable gas intake 32 is provided downstream of the burner chamber 30. When operating at high fire there is usually insufficient gas flow through the burner chamber to maintain the required flow through the flow dryer because of the breaking effect of the flame 31 on the internal walls of the burner chamber. The gas intake 32 enables the gas flow to be accurately controlled at high fire.

The agitator 14 is a rotary agitator having blades which rotate anti-clockwise in the view illustrated within an agitator chamber 33. The chamber 33 has an inlet 34 communicating with the downstream end of the inlet duct 13 and an outlet 35 communicating with the drying duct 15. Control means in the form of an outlet valve 36 located adjacent the agitator outlet 35 can be adjusted to control the required exit characteristic for comminuted matter leaving the agitator by selectively partially closing the agitator outlet.

In use, matter to be dried is fed into the agitator 14 where it is tossed and chopped by blades as they sweep through the agitator chamber 33. The agitator 14 also serves to expose the matter to the primary stream 11. A process of partial drying and comminution occurs, and as the particle size of the matter becomes smaller and lighter as moisture content is reduced, depending on the setting of agitator outlet valve 36, the particles of matter are swept by the primary stream up into the drying duct 15.

At this stage, the primary stream 11 has been degraded by the resistive effect of the agitator 14, and has become at least partially saturated and to ensure a relatively constant residence time for the particular matter being dried valve 17 is adjusted to augment the degraded primary stream with an auxiliary stream 12 to provide a combined stream of predictable character and also to boost the drying conditions in the drying duct. In particular the auxiliary stream provides unsaturated hot gas at a mass flow rate which is controlled by the setting on valve 17 and this unsaturated gas is being applied to relatively small particles as compared to the particles to which the primary stream 11 is applied to in agitator 14.

Once the optimum setting of valves 17 and 36 is achieved for a particular matter the setting can be retained as long as an adequate product is being dispensed through rotary airlock 29 of cyclone 27.

Further control over the residence time can be achieved with multi-pass operation through the return duct 19 by operation of deflector plate 25.

In any event the matter eventually reaches cyclone 27 where it is separated from the saturated gas and deposited in the cyclone as meal.

It will be evident from the foregoing that a number of operating parameters can be independently and/or complimentarily adjusted to provide optimum drying conditions for a variety of different materials.

Notably, valve 17 can be adjusted to vary the mass flow rates of auxiliary stream 12 and the primary stream 11 and hence the conditions in the drying duct 15 and agitator 14, valve 36 can be adjusted to vary the time matter is cycled through the agitator and thereby in addition to or independently of valve 17 vary and modify the residence time of matter in the agitator, and deflector plate 25 can be adjusted for recycling matter along return duct 19. The applicant has found that the most critical factor is the outlet valve setting but the valve 17 and plate 25 setting can be utilised to fine tune the output product characteristics.

Figure 2:
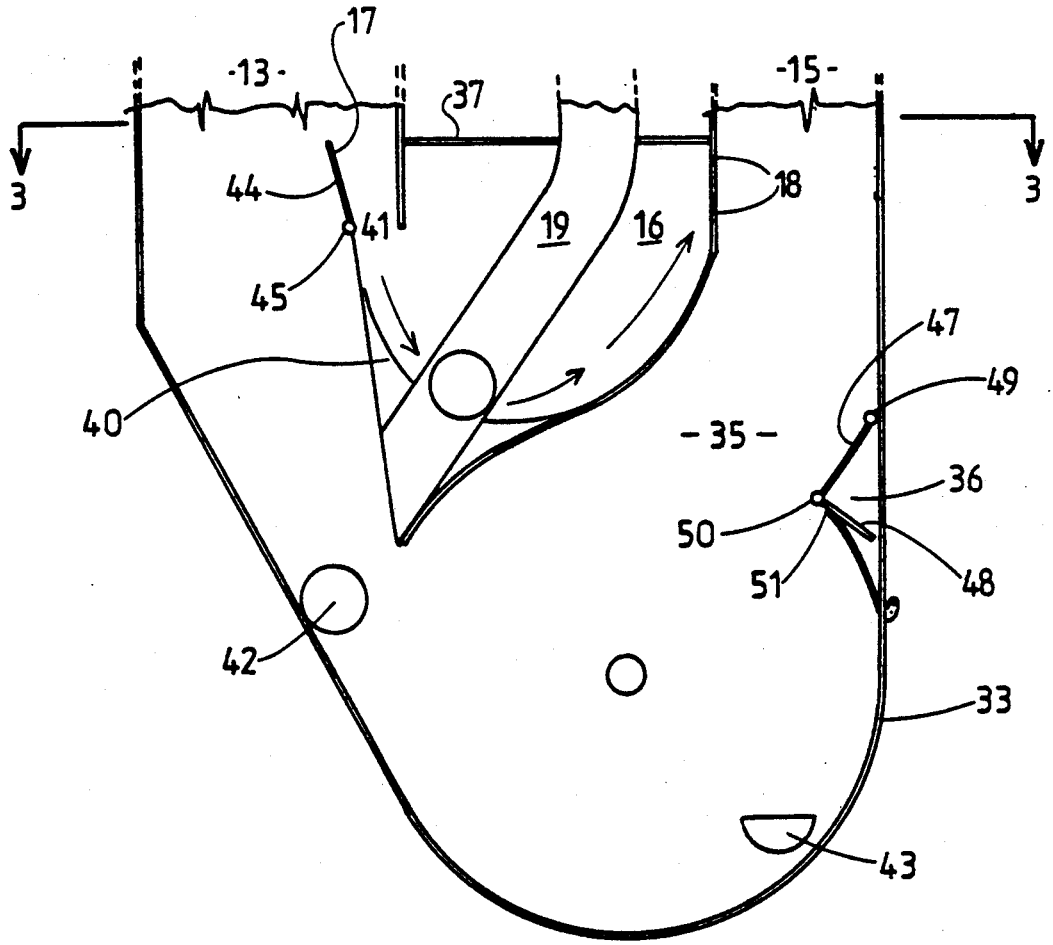
FIG. 2 illustrates a portion of FIG. 1 in larger scale.
Figure 3:
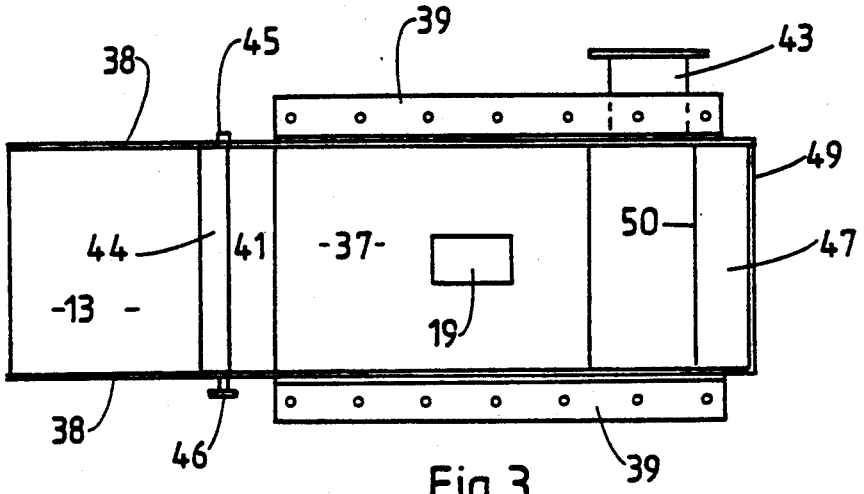
FIG. 3 is a horizontal section through the flow dryer of FIG. 1 corresponding to line 3—3 of FIG. 2.
Figure 5:
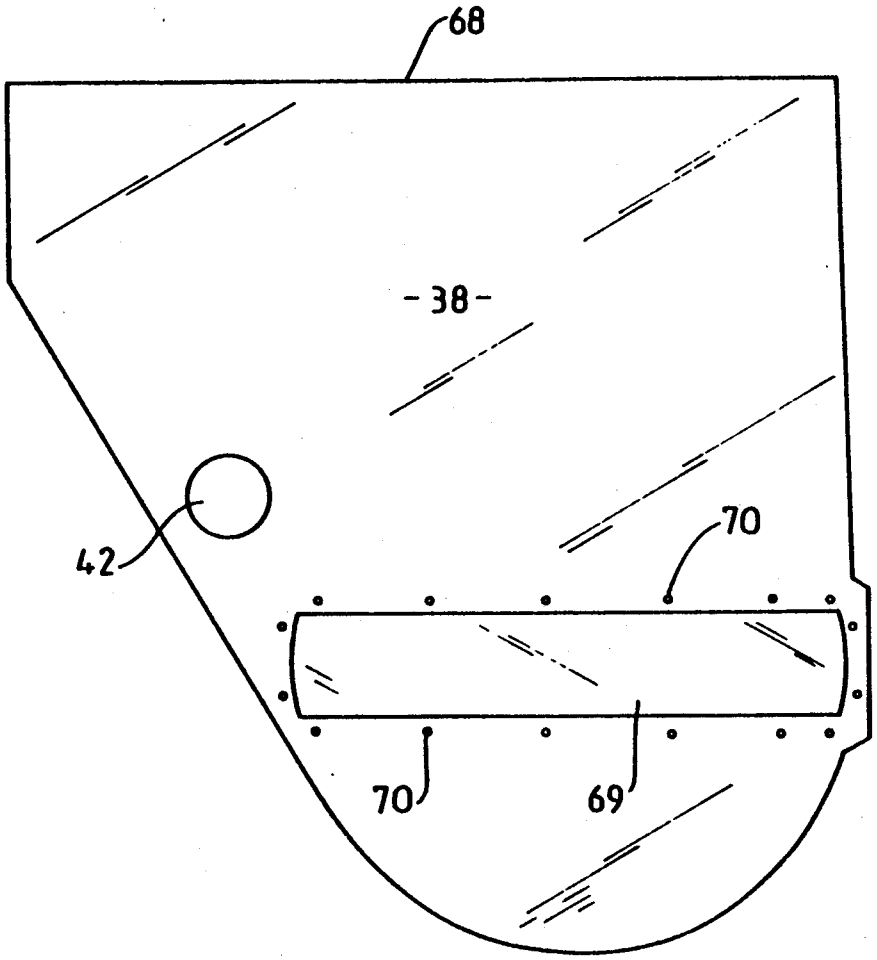

Referring to FIGS. 2 and 3, where like numerals illustrate like features the portion of the flow dryer of FIG. 1 below the plenum 16 can be seen in greater detail, the agitator blades have been omitted for clarity. The return duct 19 passes through the top plate 37 of the plenum 16 and the auxiliary stream 12 passes about the return duct 19 as the stream flows through the plenum 16. The plenum 16 is formed using plate 37 to bridge between inlet duct 13 and drying duct 15 while side plates 38 (one of which is shown in FIG. 5) extend up to plate 37 to enclose the agitator chamber 33, the plenum 16 and the ducts 13 and 15. This construction provides an upright compact unit which can be easily transported. A curved in-fill plate 40 defines a portion of the lower wall of the plenum so that gas entering the plenum flows along a smoothly curving path from the plenum inlet 41 to the outlet grid 18.

Figure 6:
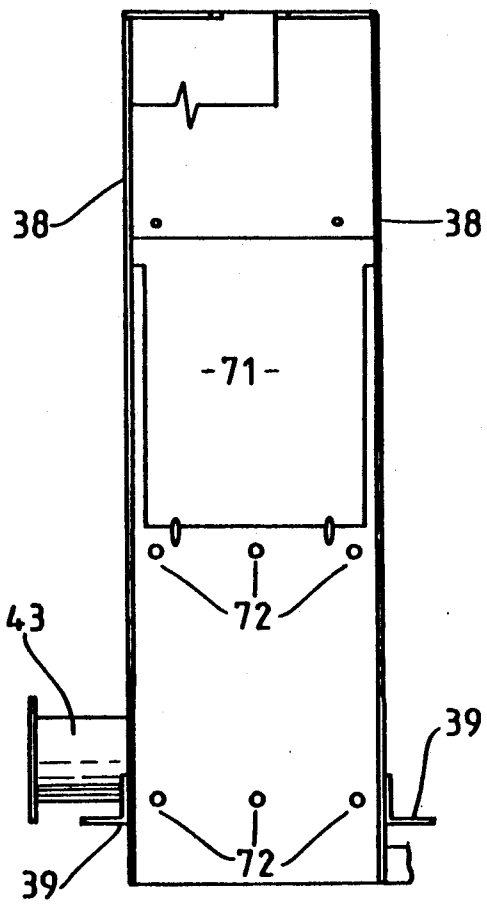
FIGS. 5 and 6 illustrate further details of the agitator chamber which facilitate servicing of the agitator.

The flow dryer can be mounted to a supporting frame (not shown) using angle brackets 39 (seen more clearly in FIG. 6).

The main input feed to the agitator chamber 33 is through a main feed opening 42 in the side plate 38 to which a feed auger (not shown) can be attached. A return feed is illustrated at 43. The flow control valve 17 comprises a valve plate 44 mounted on a shaft 45 which bridges the inlet duct 13 between the side plates 38 adjacent the juncture between the primary inlet duct 13 and plenum inlet 41. The shaft 45 is pivotally mounted in the side plates 38 and can be rotated between selected positions using handwheel 46. In this way the valve plate 44 can be selectively positioned to intercept more or less of the common stream 11.

The agitator outlet valve 36 includes two plate sections 47 and 48 which bridge across drying duct 15. Further details of the operation of valve 36 will be given below in respect of FIG. 4. Suffice it to say at present that plate 47 pivots about pivot 49 while plate 48 pivots about pivot 50 as plate 48 slides over edge 51 of the agitator outlet 35. In this way the size of the agitator outlet 35 can be selectively varied.

Figure 4:
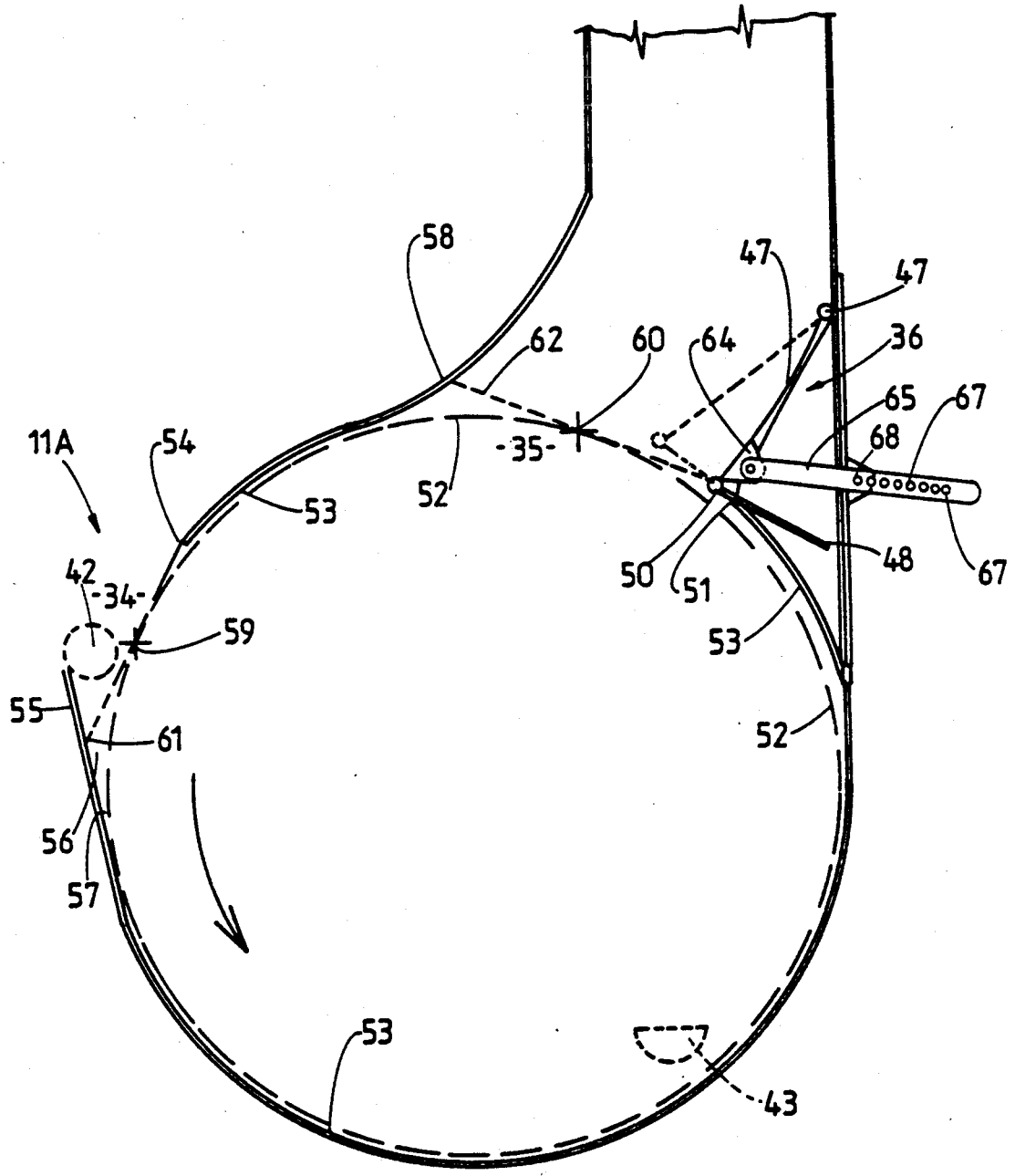
FIG. 4 is a part vertical cross-sectional view illustrating a preferred agitator and the operation of a preferred agitator outlet valve.

Referring to FIG. 4 the agitator chamber 33 is illustrated in enlarged scale and like numerals have been used to illustrate like features. The circle 52 shown in broken outline represents the peripheral cutting arc of the agitator blades. The blades have been omitted for clarity. In the actual construction the agitator blades are spaced approximately three millimeters from the inner wall 53 of the agitator chamber 33. The main input feed 42 and the return feed 43 are also shown in broken outline.

The illustrated embodiment reduces the chance of build up of material on the inner walls of the flow dryer adjacent he inlet 34 and the outlet 35. Therefore there is less likelihood of fire occurring in the agitator. Comminuted matter which is being tossed about and chopped by the agitator blades in general would be thrown at a tangent to circle 52. The blades rotate at about 1400 rpm and as a consequence most matter in the agitator is contained in an annular stream with very little matter in the centre of the chamber.

At inlet 34 material carried by the blades is no longer restricted by the chamber walls after the blades pass edge 54. At this point particles tend to pass out of the agitator inlet at high velocity and tend to stick to the tangential wall section 55. However, these particles which pass out of the agitator inlet are also under the influence of the incoming primary stream 11 so they follow a curved path to be deposited in the region bounded by the lead lines corresponding to numerals 56 and 57. As a consequence of the illustrated geometry of the agitator inlet 34 the blades tend to remove any build up of material and the tangential wall section 55 remains relatively clean.

Similar considerations apply to the wall section 58 of outlet 35.

In general, the respective centers 59 and 60 of the agitator inlet and the agitator outlet are located approximately on the midline of the imaginary tangential surfaces 61 and 62 of an imaginary cylinder defined by circle 52.

The size of the agitator outlet 35 can be varied using the agitator outlet valve 36. Details of the agitator outlet valve 36 are shown, and as can be seen the plate 47 is pivotally connected to the drying duct wall 63 at pivot 49, and has a flange 64 to which a control rod 65 is pivotally mounted. The control rod 65 passes through an aperture in wall 63 adjacent a further flange 66 extending from wall 63. A hole in the flange 66 is adapted to be selectively aligned with any one of a plurality of holes 67 on control rod 65, in this way control rod 65 can be used to move the plate 47 from its fully retracted position as shown, to its fully extended position as shown in broken outline. A set lock pin 68 can be inserted through the aligned holes to lock the control rod at any one of the selected positions.

As the plate 47 is extended the plate 48 is free to pivot about pivot 50 and plate 48 will ride over edge 51 thus, pivot 50 defines a variable location peripheral edge for the agitator outlet 35.

By operation of the control rod 65 the effective size of the agitator outlet can be changed. The effect of this on the matter in the agitator depends on the prevailing conditions in the agitator and on the nature of the matter being processed but it has been found that the agitator outlet valve can be used as a qualitative adjustment which can vary the characteristics of the end product by enabling the residence time of the matter in the agitator to be controlled.

In the illustrated embodiment of course, this control is complimentary to the control afforded by valve 17 as discussed earlier. The agitator outlet can be used to qualitatively determine the exit characteristics of the matter from the agitator in order to optimise the end product. Once the product has been optimised at a particular setting the setting is then retained for the processing of subsequent matter.

The return feed 43 is located in a position which enables only a short residence time for the returned matter. It must be noted that the return matter has already been processed through the flow dryer and each particle has therefore attained the required exit characteristics within a range considered optimum, but it will be appreciated that a range of particle sizes will result from a single pass, and it may be desirable to have a minimal further processing in order to further reduce the size of the particles but with only minimal further drying. Under these circumstances a complete pass through the agitator is not desirable and consequently the return feed inlet is located nearer the agitator outlet.

Referring to FIG. 5 there is illustrated one side plate 38. The side plate 38 has an upper edge 68 which during construction of a flow dryer is aligned with the top plate 37 of plenum 16 (see FIG. 2). By using two side plates the construction of the lower portion of the flow dryer (as shown in FIG. 2) can be simplified. In order to access the interior of the agitator a service opening 69 is provided in the side plate 38. The service opening is elongate and has its centre approximately co-incident with the location of the agitator shaft so that the elongate agitator blades can be readily replaced and/or serviced. A cover plate (not shown) is used to cover the service opening 69 via bolts passing through the peripheral holes 70.

FIG. 6 is a side view of FIG. 3 illustrating a further service opening with its cover plate removed. This service opening is used to enable a wear lining (FIG. 7) to be inserted into the agitator chamber and secured through fixing holes 72.

Figure 7:
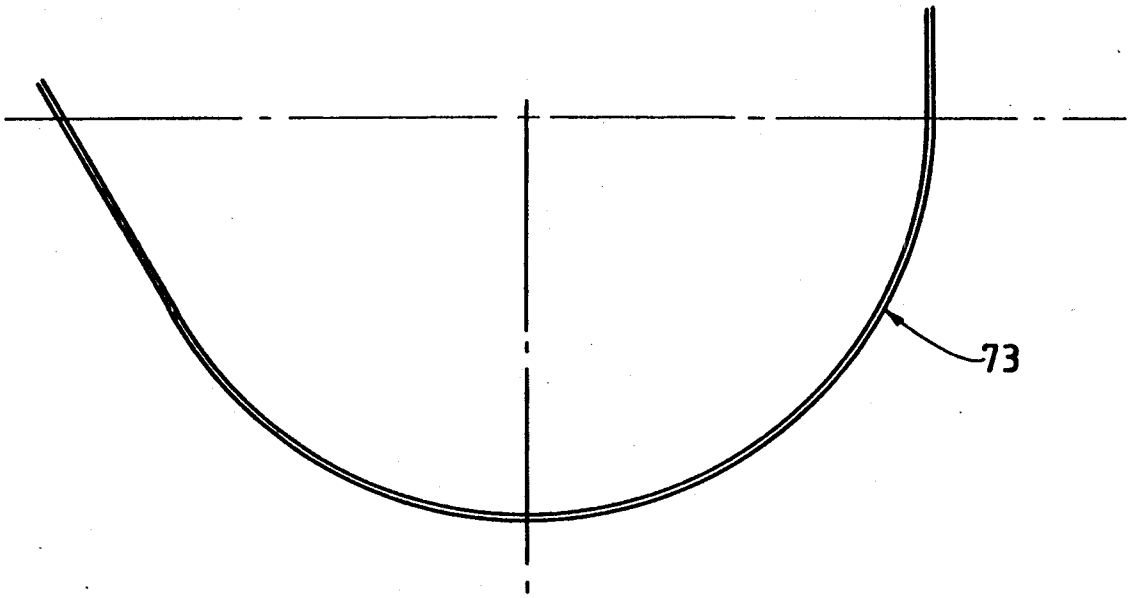
FIG. 7 illustrates a removable agitator wear lining which can be employed in conjunction with the service features illustrated in FIGS. 5 and 6.

An appropriate wear lining 73 is illustrated in FIG. 7 and is in this case a precurved manganese steel alloy and is preferably BISALLOY 80. The wear lining is configured to the shape of the lower internal curved wall of the agitator chamber.

Referring to FIGS. 8, 9 and 10 the drying duct 15 and return duct 19 are illustrated in greater detail and like numerals have been used to illustrate like features. The partition 24 in the illustrated embodiment comprises two adjustable baffles 74 which can be selectively moved as shown in broken outline in order to vary the length of the drying duct. A cover plate 75 enables access to the baffles 74. The baffles may be omitted, and in order to reduce cost the partition 24 can be a fixed wall. The baffles are not shown in FIG. 8.

Inspection plates 76 and 77 are strategically located to enable access to the plate 25 and the lower end of the return duct. A flange 78 is provided at the outlet duct 26 to which a further ducting can be connected.

Referring to FIGS. 8A and 8B the plate 25 is illustrated in greater detail. FIG. 8A illustrates the operation of the deflector plate 25 while FIG. 8B illustrates a preferred deflector plate 25.

As can be seen the deflector plate 25 is made up of two principal plate sections 79 and 80. The plate 79 is rigidly connected to a flange plate 81 which extends from a shaft 82. The plate 80 is slidable on the plate 79 and can be retracted or extended. The plate 80 is shown fully extended in FIG. 8B.

In FIG. 8A three positions 83, 84 and 85 of the deflector plate 25 are shown in broken outline to illustrate its operation. The appropriate control rods have been omitted for clarity but it will be understood that shaft 82 bridges across the drying duct, and the deflector plate 25 is externally controllable.

Position 85 illustrates the plate 80 fully retracted and in position 84 it is fully extended. In position 83 it is partially extended.

The deflector plate can be set at various angles to the drying duct wall 86 to cause the gas flow in the combined stream to travel along a predetermined path which can be close to or further from the drying duct in order to enhance the possibility of heavier particles travelling into the return duct.

The present embodiment therefore provides a number of controls which can be used to qualitatively adjust the operation of the flow dryer to achieve an optimum product. The particle size can be selectively varied, the mass flow rate of gas in various parts of the flow dryer can be changed to adjust the residence time of matter in that portion of the flow dryer. For example, for some materials it may be desirable to have a short time in the agitator while for other material it may not, whereas a relatively long period of time in the drying duct may be desirable.

Figure 11:
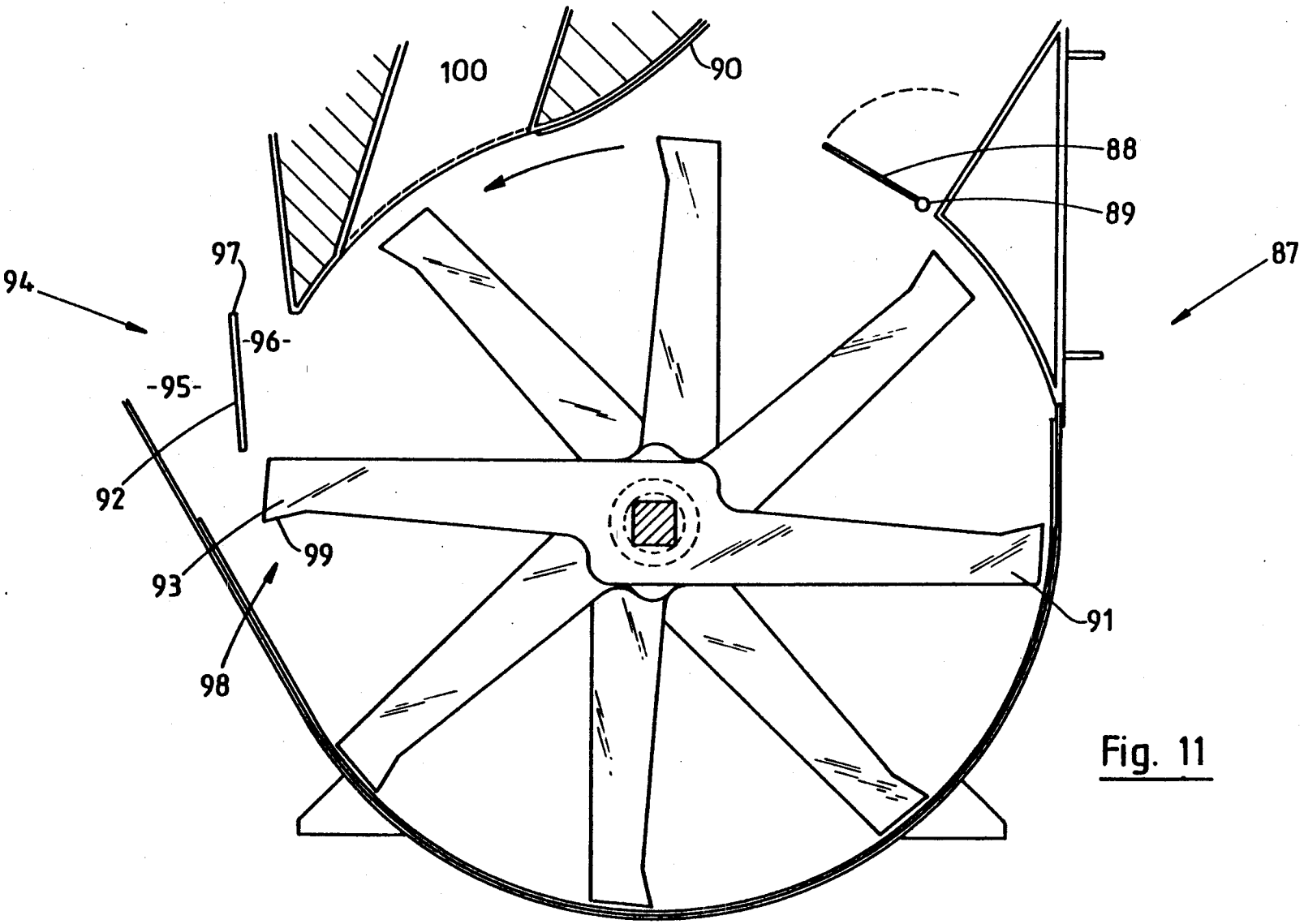
FIG. 11 is a cross-sectional view illustrating a further embodiment of an agitator constructed according to the present invention.

FIG. 11 is a cross-sectional view illustrating a further preferred agitator constructed according to the present invention. While the agitator of FIG. 1 is suitable for processing lightweight matter the agitator construction has a number of deficiencies. For example, when treating materials such as bones there is a tendency for the bones to be deflected through the agitator inlet and due to the velocity imparted to the bone product, and their size, the bone product is liable to travel backward against a primary stream through the inlet and into the burner chamber. Another problem arises with the specific form of outlet valve employed wherein their is a tendency for the product to accumulate adjacent the outlet valve. In addition, rotation of the blades tends to promote outward radial movement of particles in the agitator, whereas it would be more desirable to keep particles within the volume inscribed by the blades in order to enhance comminution thereof. In the embodiment illustrated, the agitator outlet valve includes a deflector plate 88 which can pivot on a shaft 89 through up to about 90° of arc. As illustrated in FIG. 1, the inlet duct 11 and drying duct 15 are normally positioned as vertical ducts and accordingly, when the plate 88 is vertical, the outlet valve has little effect on the residence time of matter in the agitator. However, as heavy matter in the agitator would normally have been deflected off wall portion 90 and into the drying duct prior to being adequately dried and comminuted, when the plate 88 is suitably located away from the vertical, matter striking the plate 88 will be deflected back into the path of the blades 91 and recycled through the agitator. Similarly, at the agitator inlet there is employed a deflector means in the form of a plate 92, which in this embodiment is a fixed plate but could be an adjustable plate similar to the plate 88, and matter travelling at a tangent to the arc inscribed by the free ends of blades 91 will strike the deflector plate 92 and be deflected back into the path of the blades 17. This deflector plate 92 has particular application in respect of heavy particles such as bones or the like.

An ancilliary function afforded by the configuration of the plate 92 and the agitator inlet 94 can be seen where the agitator inlet is divided by plate 90 into two pathways 95 and 96 with the free edge 97 intercepting the stream of gas delivered to the agitator so that a larger proportion of the stream passes along the passage 95 thus diverting a larger proportion of the stream of hot gas to a location adjacent the free ends 93 of the blades 91. Thus, as a consequence of the high speed rotation of the blades and centrifugal action of matter in the agitator, most particles in the agitator will be located near the free ends of the blades, and therefore the region 98 will be subjected to the greater amount of heat having delivered thereto a greater proportion of the incoming hot stream of gas.

As can be seen, the free ends 93 of each blade 91 includes a deflecting surface 99 which tends to deflect material striking the deflecting surfaces 99 inwardly and thereby eliminates to a degree, any outward radial motion that would otherwise be imparted by the free ends 93 of the blades 91.

As the particles approach the free end 93 of each blade, the particles will encounter the deflecting surface 99 and have their motion diverted back into the path of the blades. This will have noticeable effect in relation to larger particles which have a higher cross-section therefore greater probability of collision. This process will continue until such time as the exit characteristics of the particles is sufficient for them to be swept out of the agitator and into the drying duct. It will be appreciated that particles travelling adjacent the free ends 93 need not have reached the required exit characteristics and as a consequence of the construction of the blades, a greater proportion of the particles are recycled until they reach the desired exit characteristics. Under the construction of the blades illustrated radial deflections are minimised thus ensuring that a greater proportion of particles adjacent the free ends of the blade in the main, exit the agitator as a consequence of their reaching the required exit characteristics, and not as a consequence of collisions with the free ends of the blades.

Another variation implemented in the agitator 87 of FIG. 11 is that the return duct illustrated at 100 leads matter directly into the agitator rather than the inlet duct. In this way the matter entering the agitator through the return duct 100 is not immediately subjected to the most intense heat, but is subjected to the degraded heat and thus there is less likelihood of the smaller particles being burnt as there was in the case of the embodiment of FIG. 1.

Figure 12:
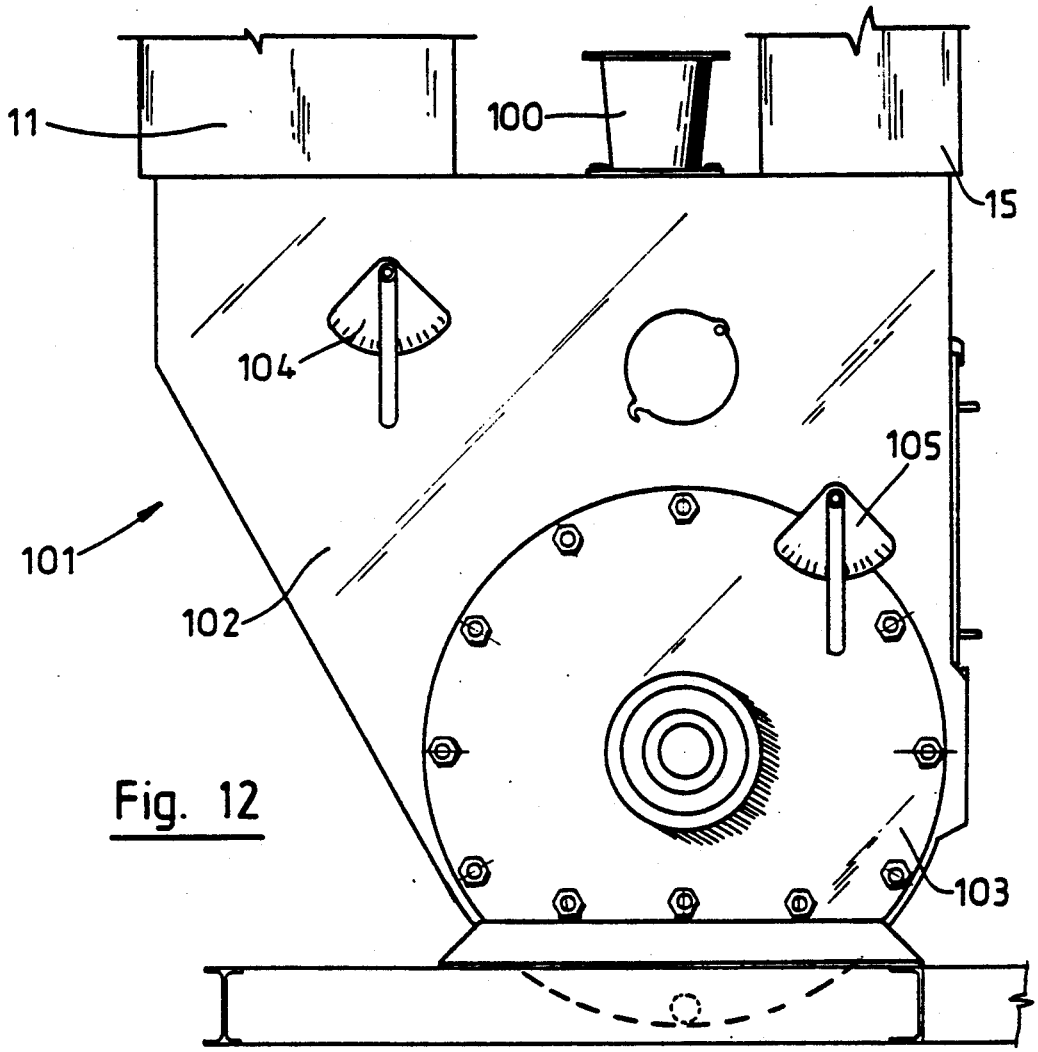
FIG. 12 is a side view illustrating a further preferred agitator constructed according to the present invention.

Referring to FIG. 12 there is illustrated a preferred external construction 100 for an agitator constructed according to the present invention. Like numerals have been used to illustrate like features, and as can be seen the agitator includes a side wall 102 and a generally circular cover plate 103, the circular cover plate 103 is employed so that the blades can be assembled on the cover plate and the blades can be dynamically balanced prior to the blades being mounted in the agitator chamber.

Calibrated controls 104 and 105 are employed for the flow control valve and the agitator outlet valve respectively.

Whilst the above has been given by way of illustrative example of the present invention it will be realised that there are many variations and modifications to the invention which will be readily apparent to those skilled in the art without departing from the broad ambit and scope of the invention as defined in the appended claims.

We claim:

1. A flow dryer suitable for comminuting and dehydrating plant or animal matter using a stream of hot gas, said flow dryer having an inlet duct in series with an agitator followed by a drying duct, said agitator having an agitator chamber including an agitator inlet communicating with the inlet duct and an agitator outlet communicating with the drying duct in order for the stream of hot gas to flow through the agitator chamber, the agitator outlet being free of any obstruction which would cause an accumulation of particles potentiating, under normal operating conditions, a possible fire within the flow dryer, a plurality of blades mounted for rotation in the agitator chamber so that particles of matter circulate in the agitator chamber while being dried, said particles of matter being resident in the agitator chamber for a period of time whereby the particles gradually acquire characteristics which enables the particles to be swept from the agitator chamber through the agitator outlet and into the drying duct as a result of the prevailing conditions in the agitator chamber, the said period of time a particle is resident in the agitator chamber being the residence time and the said acquired characteristics for a particle to be swept from the agitator chamber being that particle's exit characteristics, the agitator outlet having moveable deflector means positionable to deflect particles, which would otherwise exit the agitator chamber, back into the path of the blades in order to vary the residence time of particles in the agitator chamber by varying the exit characteristics required for particles leaving the agitator chamber through the agitator outlet, a classifier downstream of the drying duct, a return duct downstream of the classifier for returning unclassified particles to the agitator for further processing and an outlet downstream of the classifier for discharge of classified particles for subsequent collection.

2. A flow dryer as defined in claim 1 wherein the stream of hot gas comprises a primary stream and an auxiliary stream, the primary stream being delivered to the agitator chamber through the agitator inlet and the auxiliary stream being delivered to the drying duct downstream of the agitator chamber.

3. A flow dryer as defined in claim 2 wherein the primary stream and auxiliary stream each flow at predetermined mass flow rates and the flow dryer includes control means operable to vary the mass flow rate of hot gas in the primary stream or the auxiliary stream.

4. A flow dryer as defined in claim 3 wherein the control means is operable to control the mass flow rate of hot gas in the primary stream so as to be inversely proportional to the mass flow rate of hot gas in the auxiliary stream.

5. A flow dryer as defined in claim 4 wherein the inlet duct includes a primary inlet duct communicating with the agitator chamber through the agitator inlet and an auxiliary inlet duct communicating with the drying duct at a location adjacent the agitator outlet, and said control means comprises a flow control valve for diverting hot gas into the auxiliary inlet duct for delivery to the drying duct.

6. A flow dryer as defined in any one of claims 1 to 5 wherein the inlet duct includes an upstream end remote from the agitator inlet and further including a burner chamber communicating with the upstream end of the inlet duct and a gas intake downstream of the burner chamber in order to compensate for any losses in gas velocity or mass flow rate as a consequence of burner operation.

7. A flow dryer according to any one of claims 1 to 5 wherein the classifier classifies particles according to physical characteristics and includes adjustment means operable to alter operation of the classifier so that particles that would otherwise be discharged through the outlet are returned to the agitator via the return duct.

8. A process for comminuting and dehydrating a quantity of moist plant or animal matter using a stream of hot gas flowing through a flow dryer, the flow dryer having an inlet duct in series with an agitator followed by a drying duct, the agitator having an agitator chamber including an agitator inlet communicating with the inlet duct and an agitator outlet communicating with the drying duct in order for the stream of hot gas to flow through the agitator chamber, the agitator outlet being free of any obstacles which would cause an accumulation of particles potentiating, under normal operating conditions, a possible fire in the flow dryer, a plurality of blades mounted for rotation in the agitator chamber so that particles of matter circulate in the agitator chamber while being dried, said particles of matter being resident in the agitator chamber for a period of time whereby the particles gradually acquire characteristics which enables the particles to be swept from the agitator chamber through the agitator outlet and into the drying duct as a result of the prevailing conditions in the agitator chamber, the said period of time a particle is resident in the agitator chamber being the residence time and the said exit characteristics for a particle to be swept from the agitator chamber being that particles exit characteristics, the agitator outlet having moveable deflector means positionable to deflect particles, which would otherwise exit the agitator chamber, back into the path of the blades, the process comprising, simultaneously introducing a portion of the moist matter into the agitator chamber while subjecting the portion of moist matter to the stream of hot gas while at the same time rotating the blades so that the moist matter is partially dried and comminuted into particles which are eventually swept out of the agitator chamber through the agitator outlet, classifying the particles swept from the agitator chamber into a return stream to be recycled through the flow dryer and an outlet stream to be separated from the stream of gas as initial product, returning the return stream to the agitator, and subsequently examining the initial product, adjusting the position of the moveable deflector means thereby adjusting the residence time of particles in the agitator chamber to an optimum setting by varying the required exit characteristics for particles leaving the agitator through the agitator outlet to achieve a desired product from the outlet stream and thereafter processing more of the moist matter using the optimum residence time setting and collecting more of the desired product.

9. The process of claim 8 further including delivering an auxiliary stream of hot gas into the drying duct.

10. The process of claim 8 or 9 wherein the stream of hot gas is delivered to the agitator at a predetermined mass flow rate and the process further includes controlling the mass flow rate of hot gas delivered to the agitator in order to further vary the required exit characteristics for matter leaving the agitator chamber.

11. The process of claim 8 wherein the deflector means can be used to partially close the agitator outlet and the process further includes partially closing the agitator outlet in order to vary the required exit characteristics for matter leaving the agitator chamber.

12. A process according to claim 8 wherein the hot gas stream is delivered to the agitator at a temperature of from 200° C. to 1300° C. and preferably from 200° C. to 500° C.

13. A process for drying and comminuting a quantity of moist plant or animal matter using a stream of hot gas flowing through a flow dryer, the flow dryer having an inlet duct in series with an agitator followed by a drying duct, the process comprising feeding matter into the agitator, simultaneously comminuting the matter in the agitator while subjecting the matter in the agitator to a primary stream of hot gas at a temperature of from 200° C. to 1300° C., preferably from 200° C. to 500° C. to form comminuted matter in the agitator, directing said primary stream to dehydrate the comminuted matter in the agitator for a predetermined period of time until the comminuted matter acquires required exit characteristics for the comminuted matter to leave the agitator to become entrained comminuted matter in the primary stream of hot gas, subsequently introducing into said primary stream an auxiliary stream of hot gas at a temperature of from 200° C. to 1300° C., preferably from 200° C. to 500° C., at a controlled mass flow rate to form with the primary stream and the entrained comminuted matter, a combined stream of gas in the drying duct, classifying the combined stream of gas and the entrained comminuted matter contained therein into a return stream of comminuted matter to be recycled through the flow dryer, and an outlet stream of saturated gas containing relatively dry comminuted matter, returning the return stream of comminuted matter into either the primary stream or the combined stream of hot gas, separating the relatively dry comminuted matter from the saturated gas in the outlet stream, exhausting the saturated gas in the outlet stream and collecting the relatively dry comminuted matter.

* * * * *